US005983536A

United States Patent [19]

Fourny et al.

[11] Patent Number: 5,983,536

[45] Date of Patent: Nov. 16, 1999

[54] ELECTRICAL STEAM IRON WITH STEAM CHANNELS

[75] Inventors: Jacky Rene Paul Fourny, Berus; Guy De Maneville, Alencon, both of France

[73] Assignee: Moulinex S.A., Paris, France

[21] Appl. No.: 09/077,032

[22] PCT Filed: Nov. 15, 1996

[86] PCT No.: PCT/FR96/01807

§ 371 Date: May 18, 1998

§ 102(e) Date: May 18, 1998

[87] PCT Pub. No.: WO97/19215

PCT Pub. Date: May 29, 1997

[30] Foreign Application Priority Data

Nov. 17, 1995 [FR] France ..... 95 13656

[51] Int. Cl.[6] ..... D06F 75/20; D06F 75/38

[52] U.S. Cl. ..... 38/93; 38/77.83

[58] Field of Search ..... 38/93, 77.83, 88; 219/245, 254

[56] References Cited

U.S. PATENT DOCUMENTS

| | | | |
|---|---|---|---|
| 3,919,793 | 11/1975 | Toft et al. | 38/77.83 |
| 4,233,763 | 11/1980 | McMullen | 38/93 |
| 4,837,952 | 6/1989 | Hennuy et al. | 38/77.83 X |
| 5,146,700 | 9/1992 | Prosser | 38/93 X |

FOREIGN PATENT DOCUMENTS

| | | | |
|---|---|---|---|
| 0 678 617 | 10/1995 | European Pat. Off. . | |
| 2212457 | 7/1974 | France . | |
| 2 290 524 | 6/1976 | France . | |
| 2 648 166 | 12/1990 | France . | |
| 2852165 | 6/1980 | Germany | 38/77.83 |
| 2 225 345 | 5/1990 | United Kingdom . | |

*Primary Examiner*—Ismael Izaguirre
*Attorney, Agent, or Firm*—Young & Thompson

[57] ABSTRACT

An iron with a lower housing includes a heating base and a sole plate under the base, an evaporation chamber and a steam distribution chamber in communication with steam outlets in the sole plate. The evaporation chamber includes at least one steam channel having an outlet in the lower surface of the base and arranged in such a way that the steam flows through the evaporation chamber along a path which promotes evaporation of the water before it reaches said channel, and the distribution chamber is provided in the lower surface of the base and communicates with the outlet of the steam channel.

14 Claims, 2 Drawing Sheets

FIG_1
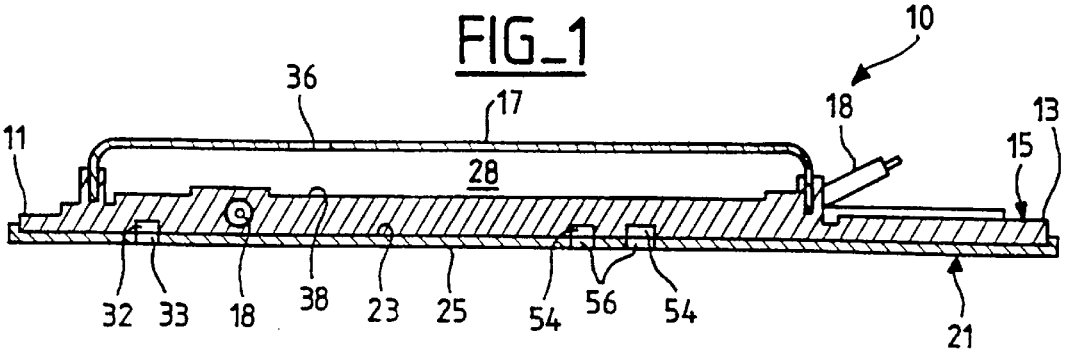
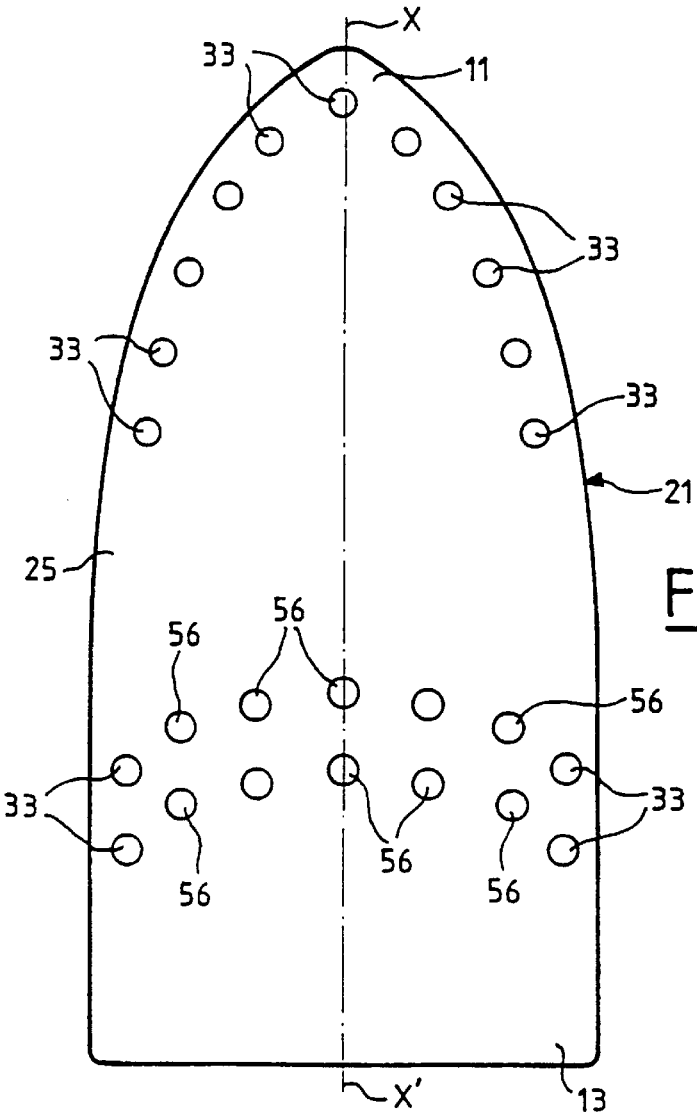
FIG_5

ELECTRICAL STEAM IRON WITH STEAM CHANNELS

BACKGROUND OF THE INVENTION

The present invention relates to electric steam irons which comprise a sole having a base heated by means of an electric resistance and an ironing plate mounted below the base, a so-called principal vaporization chamber provided in the base, closed by a cover and supplied by water by means of an injection device through an opening provided in the cover, and a chamber for distributing steam in communication with steam outlet holes pierced in the plate.

DESCRIPTION OF THE RELATED ART

In known steam irons of this type, the steam distribution chamber is provided in the upper surface of the heating base, at the periphery of the base and outside the principal vaporization chamber, being separated from the latter by a partition, and communicating with the vaporization chamber through at least one opening provided in the partition; the distribution chamber comprises steam distribution openings corresponding to steam outlet holes pierced in the ironing plate. This type of iron has the great drawback of not being able to provide perfect sealing between the principal vaporization chamber and the distribution chamber. Thus, as a result of improper fabrication or mounting, a certain play can be present between the cover and the partition separating the two chambers, such that unvaporized water can pass directly from the vaporization chamber to the distribution chamber, giving rise to the risk of projection of droplets of water through the outlet holes. Projection of water moistens the laundry, which detracts from the quality of pressing, and after several thermal cycles, small platelets of calculus pass into the distribution chamber, finally plugging the distribution openings, and hence the outlet holes.

SUMMARY OF THE INVENTION

The invention has particularly for its object to overcome these drawbacks and to provide a steam iron, of the type described above, whose sole involves an improved design permitting high quality ironing, suitable for mass production and at reduced cost.

According to the invention, the principal vaporization chamber comprises at least one steam passage which opens on the lower surface of the base and which is arranged such that the vapor moves into said principal vaporization chamber along a path suitable to promote the vaporization of the water before reaching said passage, and the steam distribution chamber is arranged in the lower surface of the base and is in communication with the outlet of said steam passage.

Thus, the provision of the steam distribution chamber in the lower surface of the heating base, and no longer in the upper surface of the latter as in the prior art, whilst communicating in a simple manner with the principal vaporization chamber thanks to the opening of the passage, now permits overcoming the problem of sealing between the two chambers particularly if there has been improper production or mounting of the closing cover. Moreover, the heating base being obtained by molding, the provision of the distribution chamber directly in the lower surface of the base permits greatly simplifying the existing mold.

According to another important characteristic of the invention, the principal vaporization chamber being delimited by a peripheral partition on which bears the cover and comprising a plurality of steam passages, these passages are constituted by vertical chimneys arranged about the periphery of said peripheral partition, opening into the steam distribution chamber and proceeding upward toward the cover by leaving on at least one portion a small space with said cover so as to permit the passage of the steam through said space in the upper portion of each of the chimneys.

Thus, thanks to this steam passage in the upper portion of the chimneys, the unvaporized droplets of water can almost not at all leave these chimneys, and hence pass into the subjacent distribution chamber, thereby avoiding any risk of projection of water through the outlet holes, and thus any blocking of the distribution chamber. Moreover, this escape of steam through the upper portion of the chimneys ensures excellent operation of the iron in a vertical position to smooth delicate cloth.

According to a preferred embodiment, the vertical chimneys are two in number and are arranged respectively on the two opposite lateral sides of the peripheral partition of the principal vaporization chamber. Preferably, the two vertical chimneys are symmetrical relative to the longitudinal axis of the sole and are each located substantially in the central lateral region of the vaporization chamber.

BRIEF DESCRIPTION OF THE DRAWINGS

The characteristics and advantages of the invention will become better apparent from the description which follows, by way of non-limiting example, with reference to the accompanying drawings, in which:

FIG. 1 is a cross-sectional view of a sole provided with a cover of a steam iron according to the invention;

FIG. 5 is a plan view of the external surface of an ironing plate of the sole of FIG. 1.

DESCRIPTION OF THE PREFERRED EMBODIMENTS

Figure 2:
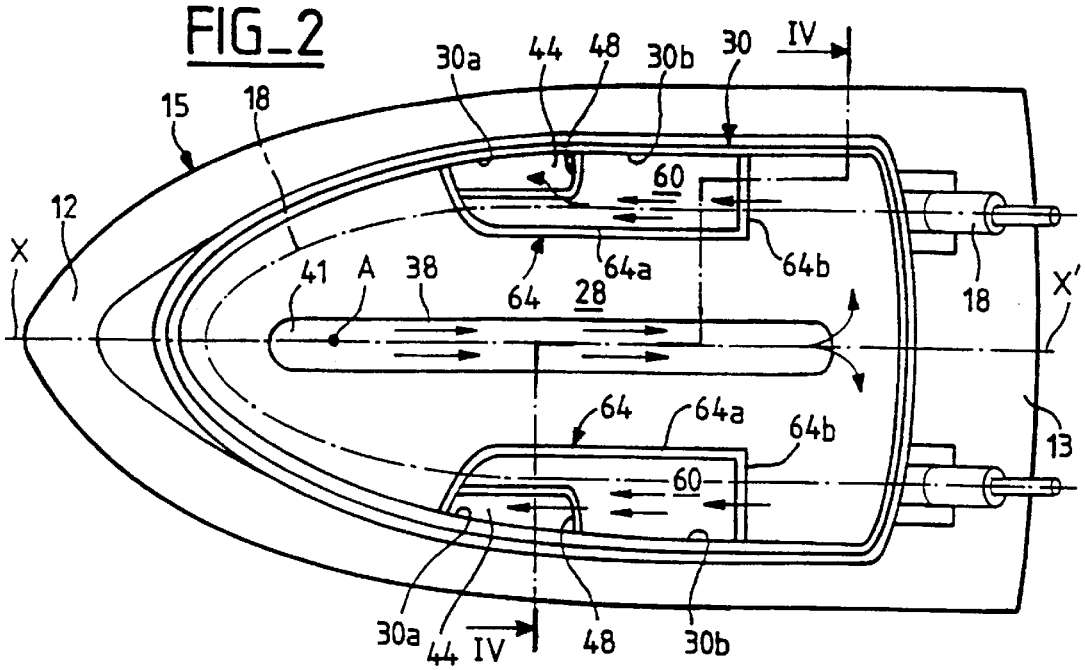
FIG. 2 is a top plan view of a heating base of the sole of FIG. 1, the cover being omitted.

In the embodiment illustrated in FIGS. 1 to 5, the electric steam iron comprises a sole, designated by the general reference 10 in FIG. 1, which extends longitudinally from a region forming a point 12 toward a region forming a heel 13 and which comprises a base or body 15 made of a molded metallic material such as for example aluminum, provided with a cover 17 of sheet metal and heated by means of a shielded electric resistance 18 embedded in its mass and having a U shape, as well as a thin ironing plate 21 made of metallic material such as for example chromium steel or stainless steel, mounted on the lower surface 23 of the heating base 15 by any suitable securement means and whose external surface 25 forms an ironing surface. The heating base 15 (FIGS. 2 and 3) and the ironing plate 21 (FIG. 5) of the sole have the same longitudinal axis of symmetry, designated XX'.

Figure 3:
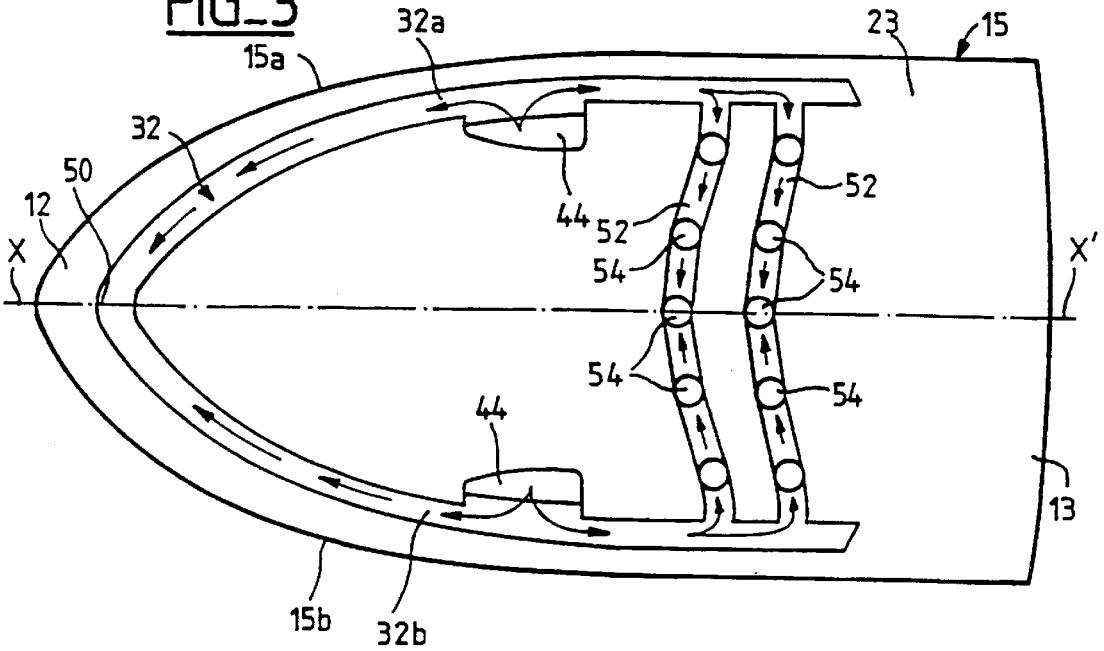
FIG. 3 is a bottom plan view of this heating base.

As shown in FIGS. 1 to 4, in the heating base 15 of the sole 10 is provided a so-called principal vaporization chamber 28 delimited by a vertical peripheral partition 30 better seen in FIG. 2, closed by the cover 17 bearing on the peripheral partition 30 (see FIG. 4), and communicating with a steam distribution chamber, shown at 32 in FIG. 3 and which will be described hereinafter, which is closed by the plate 21 and which communicates with the steam outlet holes 33 pierced in said plate 21. As is seen in FIG. 2, the branches of the shielded resistance 18 of U shape (symbolized by broken lines in FIG. 2) are closely surrounded by the vaporization chamber 28.

The principal vaporization chamber 28, of large volume, for example of the order of 50 $cm^3$, is adapted to produce a continuous stream of steam at low pressure by being supplied with water through an injection device (not shown) through an opening 26 provided in the cover 17.

In the embodiment shown in FIG. 2, there is shown at 38 a long groove with rounded ends which is sunk horizontally with a slight downward slope, for example along the axis XX', and with very little depth in the vaporization chamber 28 and of which the forward portion 41 is adapted to receive water falling through the injection opening 36.

According to the invention, concerning FIGS. 2 and 3, the principal vaporization chamber 28 comprises at least one steam passage 44 which opens on the lower surface 23 of the heating base 15 and which is arranged such that the vapor travels into the vaporization chamber 28 along a path adapted to promote the vaporization of the water before reaching the passage 44, and the steam distribution chamber 32 is provided in the lower surface 23 of the base 15 and is in communication with the outlet of the steam passage 44.

In the embodiment shown in FIGS. 2 and 3, there are provided, purely by way of illustration and in no way limiting, two steam passages 44 which are arranged on the inner side of the peripheral partition 30 of the principal vaporization chamber 28 to open into the steam distribution chamber 32.

In this example, the two outlet steam passages 44 are constituted by two identical vertical chimneys provided respectively on the two opposite lateral sides of the peripheral partition 30 of the vaporization chamber 28, and which are symmetrical relative to the axis XX' each being located substantially in the central lateral region of the principal vaporization chamber 28.

Figure 4:
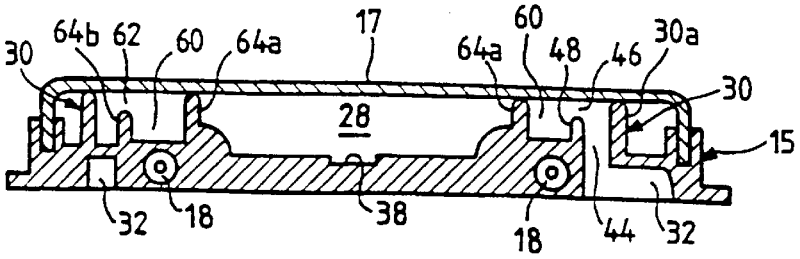
FIG. 4 is a cross-sectional view on the line IV—IV of FIG. 2, the cover being in place.

According to an important aspect of the invention, the two lateral chimneys 44 rise toward the closing cover 17 leaving at least a small portion of internal space, visible at 46 in FIG. 4, with the cover 17, so as to permit the passage of steam through said small space 46 in the upper portion of each of the two chimneys 44. Thus, the steam cannot leave the principal vaporization chamber 28 other than from the upper portion of each of the two chimneys 44, which are almost not at all subjected to projections of droplets of water, thereby permitting avoiding any blocking of the holes of the pressing plate 21, and as a result obtaining a high quality of pressing, even in the case of vertical smoothing.

Moreover, each of the two lateral chimneys 44 has a minimum predetermined cross section of the order of at least 20 $mm^2$, which minimum value corresponding to a sufficient escape of steam from the upper portion of the two chimneys so as to ensure a diffusion of continuous steam jets over the laundry to be pressed.

In the embodiment shown in FIG. 2, each of the two lateral chimneys 44 has a substantially oblong shape and is delimited vertically by a section 30*a* of the peripheral partition 30 of the principal vaporization chamber 28 and a partition 48 formed in the vaporization chamber 28 and extending adjacent the cover 17 so as to provide with the latter the internal space 46 for the passage of the steam from the upper portion of the chimney 44, see FIG. 4.

As to FIG. 3, the steam distribution chamber 32 is constituted in this case by a groove sunk in the lower surface 23 of the heating base 15 and having a substantially V shape whose two branches 32*a*, 32*b* extend respectively along and adjacent the two lateral edges 15*a*, 15*b* of the base 15 and whose point 50 is located in the region 12 forming a point of the base. In each of the two branches 32*a*, 32*b* of the V-shaped distribution groove 32 opens one of the chimneys 44, as is seen in FIG. 3, and the steam outlet openings 33 pierced in the plate 21 (FIG. 5) are distributed so as to coincide with the distribution groove 32.

As shown in FIG. 3, in the lower surface 23 of the heating base 15 is also provided at least one transverse channel 52, in this case two in number, disposed in parallel, which open at the two free ends of the V-shaped distribution groove 32 and which is adapted, by means of circular recesses 54 of small depth, to bring the steam travelling in the groove 32 into a region located approximately in the rear transverse region of the pressing plate 32 via corresponding steam outlet holes 56 pierced in the plate 21 and coinciding with the recesses 54 of each channel 52.

As to FIG. 2, within the principal vaporization chamber 28 are provided two identical decantation chambers 60, of a small volume compared to that of the principal vaporization chamber 28, of the order of 5 $cm^3$ each, in the illustrated embodiment, which are associated respectively with the two chimneys 44 and which each comprise a small passage, visible at 62 in FIG. 4, adapted to cause to enter it the steam travelling into the principal vaporization chamber 28. The two decantation chambers 60 are disposed respectively above the two lateral branches of the shielded U-shaped resistance 18, as shown schematically in FIG. 2; the shielded resistance 18 extend adjacent each of the two lateral chimneys 44.

More precisely, in the embodiment shown in FIG. 2, each of the two decantation chambers 60 is delimited vertically by a section 30*b* of the peripheral partition 30 of the principal vaporization chamber 28 which extends the front of the section 30*a* of this peripheral partition 30, the partition 48 serving to delimit the associated chimney 44, and a partition 64 having, on the one hand, a longitudinal section 64*a* connecting with the front of the section 30*a* of the peripheral partition 30 bordering the chimney 44 and extending to the same height as the peripheral partition 30 such that the cover 17 also bears on this longitudinal section 64*a* (see FIG. 4) , and on the other hand, a transverse section 64*b* connecting to the section 30*b* of the peripheral partition 30 and extending adjacent the cover 17 so as to provide with this latter an interstice forming the inlet passage 62 (FIG. 4) for steam in the decantation chamber 60.

Thus, each of the two decantation chambers 60 fulfills preferably both the function of instantaneous vaporization of all droplets of water entering the decantation chamber through the passage 62, and that of trapping or recovering the plates of calculus susceptible to form therein.

Upon an injection of water into the principal vaporization chamber 28, and at present at the level of the front portion 41 of the longitudinal groove 38 sunk in the vaporization chamber 28, through the opening 36 of the cover 17 in the sole 10, the injected water (at the point A located on the axis XX' in FIG. 2) is transformed into steam in contact with the metal heated by the shielded resistance 18. The steam travelling in the groove 38 from the chamber 28 by being guided in this groove 38, enters through each of the two passages 62 (see FIG. 4) into the corresponding decantation chamber 60 in which any droplets of water penetrating therein are vaporized instantaneously, then leaves through the upper portion of each of the two chimneys 44 through the small space 46 (see FIG. 4) to empty into the corresponding lateral branch 32*a*; 32*b* of the V-shaped steam distribution groove 32, as indicated by the arrows shown in FIG. 2.

From there, the steam is transmitted into the distribution groove 32 and is distributed in part in each of the two transverse channels 52, as shown by the arrows on FIG. 3, and leaves in continuous low pressure jets through the corresponding holes 33 and 56 of the pressing plate 21.

We claim:

1. Electric steam iron comprising a sole comprising a base heated by an electric resistance and a pressing plate mounted below said base, a so-called principal vaporization chamber provided in the base, closed by a cover and supplied with water by an injection device through an opening provided in the cover, and a steam distribution chamber communicating with steam outlet holes pierced in the plate, the principal vaporization chamber comprising at least one steam passage which opens on the lower surface of the base and which is arranged such that the vapor travels in said principal vaporization chamber along a path adapted to promote the vaporization of the water before reaching said passage, and the steam vaporization chamber is provided in the lower surface of the base and communicates with the outlet of said steam passage, the principal vaporization chamber being delimited by a peripheral partition on which bears the cover and comprising a plurality of steam passages, said steam passages are constituted by vertical chimneys arranged bordering said peripheral partition, opening into the steam distribution chamber and rising toward the cover leaving free over at least one portion a small space with said cover so as to permit the passage of the steam through said space in the upper portion of each of the chimneys, the two vertical chimneys are each delimited by a first section of the peripheral partition of the principal vaporization chamber and a first vertical partition formed in said principal vaporization chamber and extending adjacent the closure cover.

2. The iron of claim 1, further comprising two decantation chambers each delimited by a second section of the peripheral partition of the principal vaporization chamber which prolongs the rear of the first section of each peripheral partition, the first vertical partition delimiting the associated chimney and a second vertical partition having, on the one hand, a longitudinal section connecting to the front of said first section of the peripheral partition bordering the chimney and extending to the level of said peripheral partition, and, on the other hand, a transverse section connecting with said second section of the peripheral partition and extending adjacent the cover so as to form the passage for inlet of the steam into the decantation chamber.

3. Electric steam iron comprising a sole comprising a base heated by an electric resistance and a pressing plate mounted below said base, a so-called principal vaporization chamber provided in the base, closed by a cover and supplied with water by an injection device through an opening provided in the cover, and a steam distribution chamber communicating with steam outlet holes pierced in the plate, the principal vaporization chamber comprising at least one steam passage which opens on the lower surface of the base and which is arranged such that the vapor travels in said principal vaporization chamber along a path adapted to promote the vaporization of the water before reaching said passage, and the steam vaporization chamber is provided in the lower surface of the base and communicates with the outlet of said steam passage, the principal vaporization chamber being delimited by a peripheral partition on which bears the cover and comprising a plurality of steam passages, said steam passages are constituted by vertical chimneys arranged bordering said peripheral partition, opening into the steam distribution chamber and rising toward the cover leaving free over at least one portion a small space with said cover so as to permit the passage of the steam through said space in the upper portion of each of the chimneys, the vertical chimneys being two in number and arranged respectively on the two opposite lateral sides of the peripheral partition of the principal vaporization chamber, the interior of the principal vaporization chamber being provided with two decantation chambers which are associated respectively with the two vertical chimneys and which each comprise an inlet passage for steam travelling in said principal vaporization chamber, said vapor escaping, after passage into the decantation chamber, from the upper portion of the associated chimney.

4. The iron of claim 3, wherein the electrical heating resistance comprises a shielded resistance embedded in the mass of the base and having a U shape whose branches are surrounded in adjacency by the principal vaporization chamber, the two decantation chambers are disposed respectively above the two lateral branches of the U-shaped shielded resistance, said shielded resistance extending adjacent each of the two vertical chimneys.

5. An electric steam iron comprising:

a sole, said sole comprising a base heated by an electric resistance and a pressing plate mounted below said base;

a principal vaporization chamber provided in said base, said principal vaporization chamber being closed by a cover and supplied with water by an injection device through an opening provided in the cover, said principal vaporization chamber comprising a plurality of steam passages which each open on a lower surface of said base and which are arranged such that the vapor travels in said principal vaporization chamber along a path adapted to promote the vaporization of the water before reaching each passage;

a steam distribution chamber provided in the lower surface of said base, communicating with the outlet of said each steam passage, and communicating with steam outlet holes pierced in said pressing plate;

said principal vaporization chamber being delimited by a peripheral partition on which bears said cover; and said steam passages comprising vertical chimneys arranged bordering said peripheral partition and rising toward said cover leaving open at least one upper portion providing a small space between said upper portion and said cover so as to permit only the passage of the steam through said space in said upper portion of each of said vertical chimneys.

6. The iron of claim 5, wherein the vertical chimneys are two in number and are arranged respectively on two opposite lateral sides of said peripheral partition of said principal vaporization chamber.

7. The iron of claim 6, wherein said base and said plate of said sole have a same axis of longitudinal symmetry (XX'), said two vertical chimneys being symmetrical relative to said axis (XX') and each of said two vertical chimneys being located substantially in a central lateral region of said principal vaporization chamber.

8. The iron of claim 6, wherein each of said two vertical chimneys has a minimum cross section of the order of at least 20 $mm^2$.

9. The iron of claim 6, wherein an interior of said principal vaporization chamber comprises two decantation chambers which are associated respectively with said two vertical chimneys and which each comprise an inlet passage for steam travelling in said principal vaporization chamber, the vapor escaping, after passage into said decantation chamber, from the upper portion of the associated chimney.

10. The iron of claim 5, wherein said sole comprises a point forming region;

the steam distribution chamber comprises a groove sunk in the lower surface of said base having substantially a V shape with two branches extending respectively along two lateral edges of the base and whose point is located in said point forming region of said base; and each outlet of said chimneys communicate with one of the two branches of said V-shaped groove.

11. The iron of claim 10, wherein the lower surface of said base further comprises at least one transverse channel opening at two free ends of said V-shaped groove adapted to carry the steam travelling in said groove toward a transverse rear region of said pressing plate through associated steam outlet holes pierced in said pressing plate.

12. The iron of claim 5, wherein said two vertical chimneys are each delimited by a first section of said peripheral partition of said principal vaporization chamber and a first vertical partition formed in said principal vaporization chamber and extending adjacent said closure cover.

13. The iron of claim 12, further comprising two decantation chambers, each of said two decantation chambers being delimited by a second section of said peripheral partition of said principal vaporization chamber which prolongs the rear of said first section of each peripheral partition, the first vertical partition delimiting the associated chimney and a second vertical partition having a longitudinal section connecting to a front of said first section of said peripheral partition bordering the chimney and extending to the level of said peripheral partition and a transverse section connecting with said second section of said peripheral partition and extending adjacent said cover so as to form the passage for inlet of the steam into the decantation chamber.

14. The iron of claim 12, wherein the electrical heating resistance comprises a shielded resistance embedded in the mass of the base with a U shape whose branches are surrounded in adjacency by the principal vaporization chamber, the two decantation chambers being disposed respectively above the two lateral branches of the U-shaped shielded resistance, and said U-shaped shielded resistance extending adjacent each of the two vertical chimneys.

* * * * *